US009849666B2

(12) United States Patent
Schmale et al.

(10) Patent No.: US 9,849,666 B2
(45) Date of Patent: Dec. 26, 2017

(54) DEVICE FOR PRODUCING PRINTED PRODUCTS

(71) Applicant: Kolbus GmbH & Co. KG, Rahden (DE)

(72) Inventors: Christian Schmale, Pr. Strohen (DE); Kai Winkelmann, Wagenfeld (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 15/185,998

(22) Filed: Jun. 17, 2016

(65) Prior Publication Data

US 2016/0375679 A1 Dec. 29, 2016

(30) Foreign Application Priority Data

Jun. 29, 2015 (DE) ..... 10 2015 008 375

(51) Int. Cl.

| | |
|---|---|
| ***B41F 21/00*** | (2006.01) |
| ***B41F 31/30*** | (2006.01) |
| ***B41F 33/02*** | (2006.01) |
| ***B41F 13/24*** | (2006.01) |
| ***B41F 13/34*** | (2006.01) |
| ***B41F 3/00*** | (2006.01) |

(52) U.S. Cl.

CPC ..... *B41F 21/00* (2013.01); *B41F 3/00* (2013.01); *B41F 13/24* (2013.01); *B41F 13/34* (2013.01); *B41F 31/30* (2013.01); *B41F 31/307* (2013.01); *B41F 33/02* (2013.01); *B65H 2220/02* (2013.01); *B65H 2404/14* (2013.01)

(58) Field of Classification Search

CPC ..... B41F 13/34; B41F 13/36; B41F 13/38; B41F 13/40; B41F 13/44; B65H 2404/14; B65H 2220/02

USPC ..... 400/55, 57

See application file for complete search history.

(56) References Cited

U.S. PATENT DOCUMENTS

| | | | | |
|---|---|---|---|---|
| 4,319,947 | A * | 3/1982 | Tokuno | B31F 1/2831 156/351 |
| 2004/0188929 | A1* | 9/2004 | Tada | B65H 7/10 271/248 |
| 2009/0223394 | A1* | 9/2009 | Bangel | B41F 11/00 101/217 |

(Continued)

FOREIGN PATENT DOCUMENTS

| | | |
|---|---|---|
| DE | 30 32 001 A1 | 4/1981 |
| DE | 602 14 133 | 3/2007 |

(Continued)

*Primary Examiner* — Blake A Tankersley
*Assistant Examiner* — Michael Robinson
(74) *Attorney, Agent, or Firm* — Alix, Yale & Ristas, LLP

(57) ABSTRACT

The present invention pertains to a device for producing printed products comprising an arrangement of cooperating rollers that are arranged parallel to one another, wherein at least the gap width between the rollers of one roller pair is adjustable. For this purpose, one roller of the pair is pivotably mounted by means of a pivot arm, wherein a driver arranged on the pivot arm displaces a linearly movable reference element by means of a sliding block guide such that the position of this reference element corresponds to the adjusted gap width. The sliding block guide is preferably realized in such a way that the gap width and the position of the reference element are proportionally correlated.

17 Claims, 1 Drawing Sheet

(56) References Cited

U.S. PATENT DOCUMENTS

| | | | | |
|---|---|---|---|---|
| 2010/0101438 | A1* | 4/2010 | Shichijo | B65H 45/00<br>101/248 |
| 2014/0203059 | A1* | 7/2014 | Wegele | B65H 20/02<br>226/176 |

FOREIGN PATENT DOCUMENTS

| | | | |
|---|---|---|---|
| DE | 10 2008 013 315 | A1 | 9/2009 |
| EP | 1 708 885 | B1 | 9/2013 |

* cited by examiner

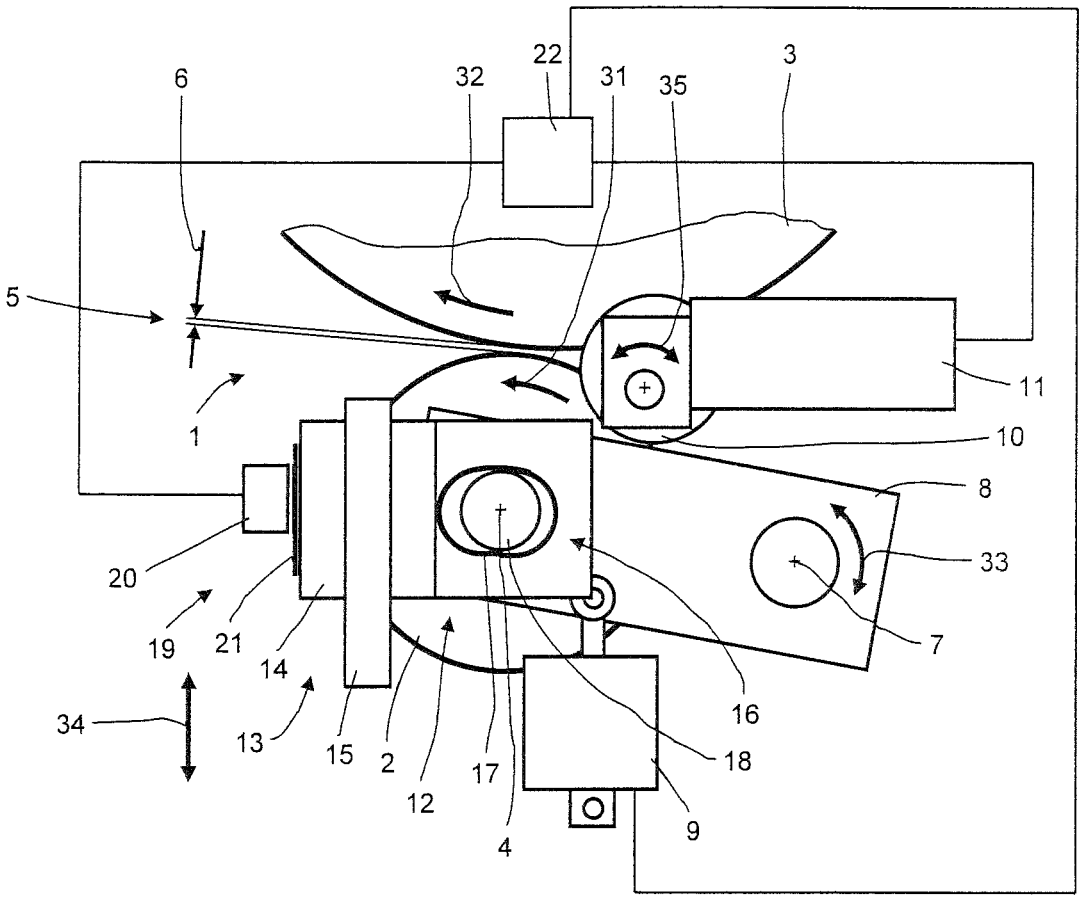
6
32
22
31
35
3
5
11
1
10
8
20
33
19
21
14
7
34
13
15
2
12
17
16
18
4
9

DEVICE FOR PRODUCING PRINTED PRODUCTS

BACKGROUND

The present invention pertains to a device for producing printed products comprising an arrangement of cooperating rollers and an apparatus for adjusting the axial spacing between two rollers.

Machines for processing paper and/or cardboard with an arrangement of several parallel rollers, which associated devices for adjusting the spacing of the rollers relative to one another, are generally known. For example, publication DE 602 14 133 T2 discloses such a machine in the form of a machine for producing corrugated cardboard. This machine comprises a first corrugating roller, which on the one hand meshes with a second corrugating roller in order to corrugate a paper web and on the other hand cooperates with a glue cylinder for applying glue onto the corrugation crests of the paper web, as well as a pressing roller that supplies a second paper web, wherein the axes of all aforementioned rollers and cylinders are arranged parallel to one another.

In order to adjust the gap between the glue cylinder and the first corrugating roller, the glue cylinder is supported in an oscillating crank construction that can be pivoted about axes extending parallel to the rollers. A pair of first cams is arranged above the plane defined by the axes of the glue cylinder and the first corrugating roller and serves as a stop for the oscillating crank construction, wherein said first cams can be adjusted independently of one another in order to achieve an exactly parallel alignment of the glue cylinder relative to the first corrugating roller. Furthermore, an additional cam is provided and arranged opposite of the pair of first cams referred to the aforementioned plane, wherein the additional cam allows the oscillating crank construction to pivot about the pair of first cams serving as a stop and thereby makes it possible to adjust the gap width.

The glue cylinder features an overrunning clutch and is driven in such a way that its circumferential speed is slightly slower than the circumferential speed of the corrugated paper web transported on the first corrugating roller. In this case, the overrunning clutch is equipped with sensors that monitor whether a driving torque is transmitted to the glue cylinder by means of the overrunning clutch. This makes it possible to indirectly monitor whether the glue cylinder is driven by means of the overrunning clutch or by means of the paper web transported on the first corrugating roller and therefore whether the gap width allows a glue transfer.

In order to adjust the desired gap width, the greatest gap width possible is initially adjusted by means of the additional cam and subsequently reduced while the machine is running until it is detected that the glue cylinder is driven by means of the corrugating roller. In this case, the actually adjusted gap width remains unknown such that this slow approach is required anew for each adjustment process and only can be carried out while the machine is running, but not at a standstill. Furthermore, such a gap width adjustment is heavily dependent on the material properties of the paper web, the glue cylinder and, if applicable, glue adhering to the glue cylinder. An excessive approach speed of the glue cylinder to the corrugating roller in connection with the sluggish information processing for the drive monitoring results in narrower gap widths than desired.

Apparatuses for adjusting rollers relative to one another in order to adjust the pressure acting upon a substrate located between the rollers are known from printing machines. In this context, publication EP 1 708 885 B1 proposes a roller bearing assembly that is composed of engaging cylinders, in the gap of which several pressure chambers are arranged distributed over the circumference. The purposeful actuation of these pressure chambers makes it possible to adjust the magnitude and the direction of the force acting upon the roller bearing assembly as a result of all pressure chambers. However, such a construction is elaborate and requires the additional use of a fluid.

In this case, the actual gap width between the rollers is also unknown and dependent on the material properties of the substrate to be printed. In addition, this type of force control can only be realized in the processing of endless webs because the processing of sheet material would inevitably cause the rollers to undesirably contact one another when a sheet exits the gap and to be abruptly pressed apart when a sheet enters the gap. This can lead to overshooting of the gap width and therefore damages to the rollers and the leading sheet edge at higher speeds.

SUMMARY

The purpose of the present invention is to provide a device of the type generally described above, whereby the adjustability of the roller gap is improved.

According to the present disclosure, at least two cooperating rollers extend parallel to one another and form a roller pair, between which a gap is formed. At least a first roller can be pivoted about an axis extending parallel to the rollers in such a way that the gap between the rollers of the pair is variable. The gap width is defined by the pivoting position of the pivotable first roller, and by at least one pivot arm, in which the pivotable first roller is mounted. At least one reference element is arranged movably by a linear guide, the position or displacement of which along its linear moving direction has a corresponding relationship to the gap width of the roller pair.

More particularly, the device for producing printed products comprises at least two cooperating rollers that form a roller pair, wherein these rollers are arranged parallel to one another and jointly form a gap. A first roller of the roller pair can be pivoted about a pivoting axis extending parallel to the rollers in such a way that the gap width of the gap formed by the roller pair is varied by pivoting the first roller about the pivoting axis. At least one pivot arm is provided for this purpose, whereby the pivot arm can be pivoted about the pivoting axis of the first roller and accommodates the bearing assembly of the first roller such that the first roller is pivoted by pivoting the pivot arm. The device further comprises a linear guide, as well as a reference element that can be linearly moved along this guide. The position of the reference element along its motion path corresponds to the gap width of the gap formed by the roller pair. In this way, the gap width is mapped in a linear reference system and therefore can be measured in a particularly simple and precise fashion without having to actually measure the rotating rollers forming the gap.

The device preferably comprises a first drive in the form of a pivot drive that is connected to and drives the pivot arm. It is advantageous to use a pivot drive in the form of a controllable drive that is actuated by a control unit of the device. In this way, heavy rolls can also be pivoted and an automation of the gap adjustment can be realized.

In another embodiment, an adjustable first stop is provided and limits the pivoting motion of the pivot arm and therefore of the first roller toward one side. The adjustable first stop is preferably arranged in such a way that it defines the smallest gap width adjustable by means of the pivot drive. This makes it possible to use pivot drives that are not very precise and therefore quite simple and cost-efficient, e.g. pneumatic cylinders, and to still achieve a very precise gap adjustment. A second drive is advantageously assigned to the adjustable first stop and connected thereto. An automated gap width adjustment particularly can be realized if the second drive is actuated by the control unit of the device.

A driver, which pivots together with the pivot arm and displaces the aforementioned reference element, is preferably arranged on the pivot arm and transmits the pivoting motion of the pivot arm and therefore of the first roller to the reference element. For this purpose, the driver engages into a guideway of the reference element similar to a sliding block guide, wherein said guideway is realized in such a way that it transforms the pivoting motion of the pivot arm into a linear motion of the reference element, and wherein the position of the reference element along its linear motion path and the gap width are proportionally correlated. In this way, the gap width, which is subject to a constant factor, can be exactly deduced from the position of the reference element without requiring additional arithmetic operations, particularly the use of trigonometric formulas.

In a particularly simple embodiment, this driver has a shoulder acting on the reference element and is incorporated by the first roller. Therefore the first roller comprises a shaft shoulder that engages into the aforementioned guideway of the reference element such that positioning errors of the reference element due to manufacturing tolerances can be additionally reduced. In this case, the shaft shoulder provides a cam roller that moves in the guideway in order to decouple the sliding block guide from the rotation of the roller and to thereby reduce its wear.

In an enhancement, the device comprises the measuring apparatus that measures the position of the reference element along its linear motion path. This measuring apparatus supplies the control unit of the device with data that is interpreted in the form of the position of the reference element and therefore in the form of the gap width. It is preferred to use a contactless position measuring system, which results in no mechanical wear, in the measuring apparatus. For this purpose, a magnetic strip, which is fixed on and moves together with the reference element, and a magnetic sensor, which is stationary referred to frame and scans the magnetic strip along an air gap, are provided. A reversed arrangement with a magnetic strip that is stationary referred to the frame and a sensor arranged on the reference element would likewise be conceivable, but not as advantageous because the line of the sensor would necessarily bend when the first roller is pivoted.

In a first embodiment, the gap adjustment of the device forms a control loop that is closed by means of the pivot drive, the measuring apparatus and the control unit of the device. In this case, the device comprises a pivot drive in the form of a controllable drive allowing arbitrary pivoting angles such that limit stops can be eliminated. This allows an automated and very precise adjustment of the gap width, in which the readout and manually requested correction by an operator are eliminated.

As an alternative or also as an addition to this first embodiment, the gap adjustment of the device forms a control loop that is closed by means of the actuating drive of the adjustable limit stop for the pivoting motion, the measuring apparatus and the control unit of the device. This alternative embodiment also has the advantage of allowing the use of very simple drives for realizing a pivoting motion from a first end position defined by a stop into a second end position defined by additional stop and vice versa. In this case, the gap width is defined by the first adjustable stop as described above. A device with the two complementary control loops of the above-described type furthermore provides greater flexibility in the design of the motion curves for gap width adjustments.

The pivot arm is advantageously realized in the form of a cam that has a simple and robust construction and allows the highly precise pivotable mounting of the first roller.

Rotary or flexographic printing units with an inventive gap adjustment provide the advantage that the roller gap can be very easily adjusted to different substrate thicknesses or different printing plate thicknesses with very high repeating accuracy such that the applicability of the printing unit can be substantially broadened with respect to these parameters.

Sheet feeders with an inventive gap adjustment of the transport gap can be adjusted to different substrate thicknesses very easily, precisely and with high repeating accuracy without damaging sensitive sheets.

BRIEF DESCRIPTION OF THE DRAWING

An exemplary embodiment of the inventive device is described in greater detail below with reference to the drawing. In this drawing:

FIG. 1 shows a schematic representation of a roller pair with an apparatus for adjusting the gap width.

DETAILED DESCRIPTION

The roller pair 1 illustrated in FIG. 1 comprises a rotatable first roller 2 and a rotatable second roller 3 extending parallel thereto, wherein said rollers jointly form a gap 5 with a gap width 6. Both rollers 2, 3 are conventionally driven by electric motors, wherein the rotating direction 31 of the first roller 2 extends opposite to the rotating direction 32 of the second roller 3, which is only partially illustrated in this FIGURE. The second roller 3 is stationarily mounted in a not-shown machine frame.

The first roller 2 is mounted movably relative to the second roller 3 such that the gap width 6 can be varied. For this purpose, an apparatus comprising a pivot arm 8 on the end of the first roller 2 is provided, wherein said pivot arm is mounted in the not-shown machine frame such that it can be pivoted about a pivoting axis 7 extending parallel to the rollers 2, 3. The first roller 2 is mounted in this pivot arm 8 and can be pivoted about the pivoting axis 7, which is stationary referred to the frame, together with the pivot arm 8 such that the gap width 6 between the first roller and the second roller is defined by the pivoting motion 33.

A drive 9 acting upon the pivot arm 8 is provided. A particularly simple drive can be realized with a pneumatic cylinder 9 that selectively pivots the pivot arm 8 with the first roller 2 into a first end position or into a second end position. The drive 9 is connected to and can be controlled by the control unit 22 of the machine in order to automate the pivoting motion 33.

The upper end position according to FIG. 1 is defined by a first stop 10 that is stationary referred to the frame. This first stop 10 is realized adjustably in the form of a cam, the axes of which extend parallel to the pivoting axis 7 of the pivot arm 8. The upper end position of the pivot arm 8 and therefore the gap width 6 of the roller pair 1 in this upper end position is defined by turning the cam 10. A second drive 11 is provided for realizing the pivoting motion 35 of the cam 10 and actuated by a control unit 22 of the machine.

Such an adjusting device is provided to both sides of the first roller 2 in order to ensure the parallelism of the rollers 2, 3 to one another at all times.

A reference element 12 is assigned to one of the pivot levers 8 and arranged such that it can be linearly displaced relative to the machine frame. For this purpose, it features a linear guide 13 consisting of a guide rail 15, which is arranged perpendicular to the pivoting axis 7, and a guide carriage 14 of conventional design. The position of the reference element 12 along this linear motion path 34 is defined by, in this case, a cylindrical driver shaft extension defining shoulder surface 18 that engages into a guideway 17 of the reference element 12 and is arranged on the pivot arm 8 such that the reference element 12 is linearly moved along by the pivot arm 8 due to the sliding block guide 16 formed by the guideway 17 and the driver 18.

The curved guideway 17 of the sliding block guide 16 is realized in such a way that the gap width 6 on the one hand and the position of the reference element 12 along its linear motion path 34 on the other hand are proportionally correlated.

For small pivoting angles of the pivot arm 8, the curved guideway 17 can be approximated with sufficient accuracy with a linear path. However, a distinctly curved guideway 17, which clearly deviates from a straight line, results for greater pivoting angles.

Even the influence of the axial offset within the roller pair 1 perpendicular to the gap width 6 on the correlation between the pivoting angle of the pivot arm 8 on the one hand and the gap width 6 on the other hand is taken into consideration in the curved guideway 17 such that the described proportional correlation between the position of the reference element 12 along its linear motion path 34 and the gap width 6 is ensured.

The device comprises a measuring apparatus 19 that measures the position of the reference element 12 along its linear motion path 34 and therefore indirectly the gap width 6. This measuring apparatus 19 is connected to the control unit 22 of the machine in such a way that this control unit 22 receives information, which it can interpret in the form of the position of the reference element 12 along its linear motion path 34 and, due to the described proportional correlation, in the form of the gap width 6.

For this purpose, the measuring apparatus 19 comprises a contactless position measuring system consisting of a magnetic strip 21, which is arranged on and moves together with the reference element 12, and a magnetic sensor 20, which is stationary referred to the frame and scans the magnetic strip 21 along an air gap, so as to transmit the data obtained thereof to the control unit 22. In order to increase the degree of automation, the control unit 22 connects the second drive 11 for adjusting the cam in the form of the first limit stop 10 and the position sensor 20 of the measuring apparatus 19 into a control loop, in which the control unit 22 serves as the controller.

A shaft shoulder of the pivotable first roller 2, which is equipped with a cam roller, serves as the driver 18 that engages into the curved guideway 17 of the sliding block guide 16 such that the axis of the driver 18 and the axis 4 of the first roller 2 are identical.

The invention claimed is:

1. A device for producing printed products, comprising:

at least two cooperating rollers (2, 3) that extend parallel to one another and form a roller pair (1), between which a gap (5) is formed;

wherein at least a first roller (2) of the roller pair (1) can be pivoted about an axis (7) extending parallel to the rollers (2, 3) in such a way that the gap (5) between the rollers (2, 3) of the pair (1) has a variable width (6);

and wherein the gap width (6) is defined by the pivoting position of the pivotable first roller (2), as pivoted with at least one pivot arm (8), in which the pivotable first roller (2) is mounted;

at least one reference element (12) cooperating with a linear guide (13) for displacement along a linear motion direction (34), and which position of the reference element along said linear moving direction corresponds to the gap width of the roller pair;

a driver surface (18) that is arranged on the pivot arm (8) and displaces the reference element (12) along its linear motion direction (34);

at least one adjustable first stop (10) that limits the pivoting motion (33) of the pivot arm (8) with the first roller (2);

and wherein the reference element (12) and the driver surface (18) are operatively connected to one another with a sliding block guide (16), and the sliding block guide (16) defines a curved surface that displaces the reference element (12) along its linear motion direction (34) proportionally to the gap width (6) of the roller pair (1).

2. The device according to claim 1, wherein a first drive (9) is connected to and drives the pivot arm (8) in such a way that it generates the pivoting motion (33) of the first roller (2).

3. The device according to claim 2, wherein the first drive (9) is responsive to a control unit (22) of the device.

4. The device according to claim 1, including a second drive (11) that is connected to and drives the adjustable first stop (10) in such a way that it adjusts the end position of the pivoting motion (33) of the pivot arm (8) with the first roller (2).

5. The device according to claim 1, wherein the pivotable first roller (2) has an extension that defines said driver surface (18) that displaces the reference element (12).

6. The device according to claim 1, wherein at least one measuring device (19) is provided for measuring the position of the reference element (12) along its linear motion direction (34).

7. The device according to claim 6, wherein the measuring device (19) is connected to a control unit (22) of the device in such a way that the control unit (22) receives information on the position of the reference element (12).

8. The device according to claim 7, wherein a first drive (9) is connected to and drives the pivot arm (8) in such a way that it generates the pivoting motion (33) of the first roller (2) and the measuring device (19) is connected to the first drive (9) for actuating the pivot arm (8) in the form of a control loop, under the control of the control unit (22).

9. The device according to claim 1, wherein the pivot arm (8) for pivoting the first roller (2) is formed by an eccentric shaft.

10. The device according to claim 2, including a driver (18) that is arranged on the pivot arm (8) and displaces the reference element (12) along its linear motion direction (34).

11. The device according to claim 2, wherein at least one measuring device (19) is provided for measuring the position of the reference element (12) along its linear motion direction (34).

12. The device according to claim 11, wherein the measuring device (19) is connected to a control unit (22) of the device in such a way that the control unit (22) receives information on the position of the reference element (12).

13. The device according to claim 2, wherein the pivot arm (8) for pivoting the first roller (2) is formed by an eccentric shaft.

14. A printing unit comprising a device according to claim 1.

15. A sheet feeder comprising a device according to claim 1.

16. A device for producing printed products, comprising:

at least two cooperating rollers (2, 3) that extend parallel to one another and form a roller pair (1), between which a gap (5) is formed, wherein at least a first roller (2) of the roller pair (1) can be pivoted about an axis (7) extending parallel to the rollers (2, 3) in such a way that the gap (5) between the rollers (2, 3) of the pair (1) has a variable width (6) and wherein the gap width (6) is defined by the pivoting position of the pivotable first roller (2), as pivoted with at least one pivot arm (8), in which the pivotable first roller (2) is mounted;

at least one reference element (12) cooperating with a linear guide (13) for displacement along a linear motion direction (34), and which position of the reference element along said linear moving direction corresponds to the gap width of the roller pair;

at least one measuring device (19) for measuring the position of the reference element (12) along its linear motion direction (34), wherein the measuring device (19) is connected to a control unit (22) of the device in such a way that the control unit (22) receives information on the position of the reference element (12);

a first drive (9) connected to the pivot arm (8) in such a way that it generates the pivoting motion (33) of the first roller (2);

at least one adjustable first stop (10) that limits the pivoting motion (33) of the pivot arm (8) with the first roller (2);

a second drive (11) connected to the adjustable first stop (10) in such a way that it adjusts the end position of the pivoting motion (33) of the pivot arm (8) with the first roller (2); and the measuring device (19) is connected to the second drive (11) for adjusting the first stop (10) in the form of a control loop, under the control of the control unit (22).

17. The device according to claim 16, wherein the reference element (12) and the driver (18) are operatively connected to one another with a sliding block guise (16), and the sliding block guide (16) defines a curved surface that displaces the reference element (12) along its linear motion direction (34) proportionally to the gap width (6) of the roller pair (1).

* * * * *